US010907370B1

(12) United States Patent
Waskey

(10) Patent No.: US 10,907,370 B1
(45) Date of Patent: Feb. 2, 2021

(54) PERSONAL POD SYSTEM

(71) Applicant: Paul Waskey, Arlington, TX (US)

(72) Inventor: Paul Waskey, Arlington, TX (US)

( * ) Notice: Subject to any disclaimer, the term of this patent is extended or adjusted under 35 U.S.C. 154(b) by 0 days.

(21) Appl. No.: 16/564,895

(22) Filed: Sep. 9, 2019

(51) Int. Cl.
*E04H 1/12* (2006.01)
*E04B 1/82* (2006.01)

(52) U.S. Cl.
CPC ..... *E04H 1/125* (2013.01); *E04B 1/82* (2013.01); *E04B 2001/8263* (2013.01)

(58) Field of Classification Search
CPC .... E04H 1/125; E04B 1/82; E04B 2001/8263
See application file for complete search history.

(56) References Cited

U.S. PATENT DOCUMENTS 3,855,746 A * 12/1974 Leggiere ..... E04F 19/061 52/213
4,389,948 A * 6/1983 Sands ..... E05G 1/024 109/79
4,513,552 A * 4/1985 Breithaupt ..... E06B 3/16 52/204.597
5,123,874 A * 6/1992 White, III ..... E04B 1/34321 181/290
5,260,525 A * 11/1993 Morse ..... E04B 1/8218 181/285
6,029,770 A * 2/2000 Schneider ..... E04B 1/8218 181/285

* cited by examiner

*Primary Examiner* — Patrick J Maestri
(74) *Attorney, Agent, or Firm* — Richard Eldredge; Eldredge Law Firm

(57) ABSTRACT

A personal pod system includes panels, each panel extending from a first side to a second side, each having a solid filler panel engaged with a flanking panel; the of panels are to secure together to create an interior area; a first connection to connect two of the plurality of panels together, the first connection having a mullion having an L-shape and engaged with a flanking frame of a first panel; one or more bolts to secure the mullion to the flanking frame; the flanking frame having a protrusion to extend over a front surface of the solid filler panel; an interior layer of acoustic material secured to the interior area of the panels; and a door engaged with the panels to provide access to the interior area; the connection is to provide a seamless appearance on an exterior of the personal pod system.

7 Claims, 7 Drawing Sheets

PERSONAL POD SYSTEM

BACKGROUND

1. Field of the Invention

The present invention relates generally to personal pods and booths, and more specifically, to a personal, modular, freestanding pod system that could be adapted for meetings, studying, sleeping or the like and provides for a seamless exterior surface with improved acoustical properties.

2. Description of Related Art

Personal pods are well known in the art and are effective means to have a private or semi-private enclosure in which a person can have a meeting, sleep, or study. These booths are commonly placed in public locations, such as libraries, offices, or even coffee shops.

There is a need and a desire to have a pod that is substantially seamless in design and allows for quality acoustical properties, thereby providing for a system that is aesthetically appealing and functional in design. It is an object of the present invention to provide for a pod that includes these qualities among others.

Accordingly, although great strides have been made in the area of personal pods, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
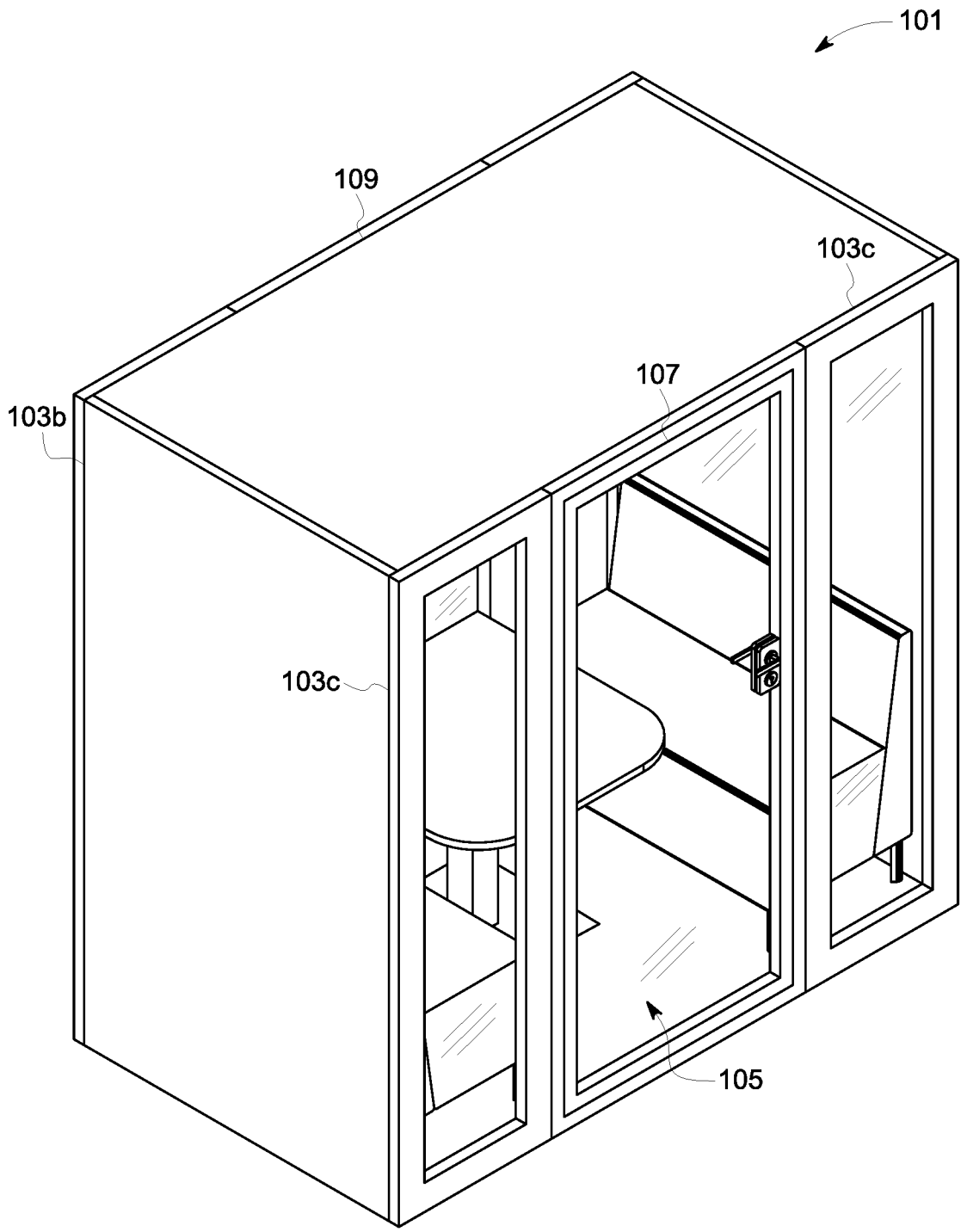
FIG. 1 is an isometric view of a personal pod system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional pod systems. Specifically, the present invention provides for a pod with a seamless design and improved aesthetical qualities. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIGS. 1-4 depict various views of a pod system 101 in accordance with a preferred embodiment of the present application. It will be appreciated that system 101 overcomes one or more of the above-listed problems commonly associated with conventional pod systems.

In the contemplated embodiment, system 101 includes a plurality of panels 103 each extending from a first side to a second side and connected to form an interior area 105. As shown, a door 107 is attached to the panels to provide access to the interior area. It should be appreciated that the size of the pod can vary based on aesthetical, functional, or manufacturing considerations. Further included is a roof 109 attached to the top ends of the panels, thereby providing a means to enclose the interior area.

Figure 2:
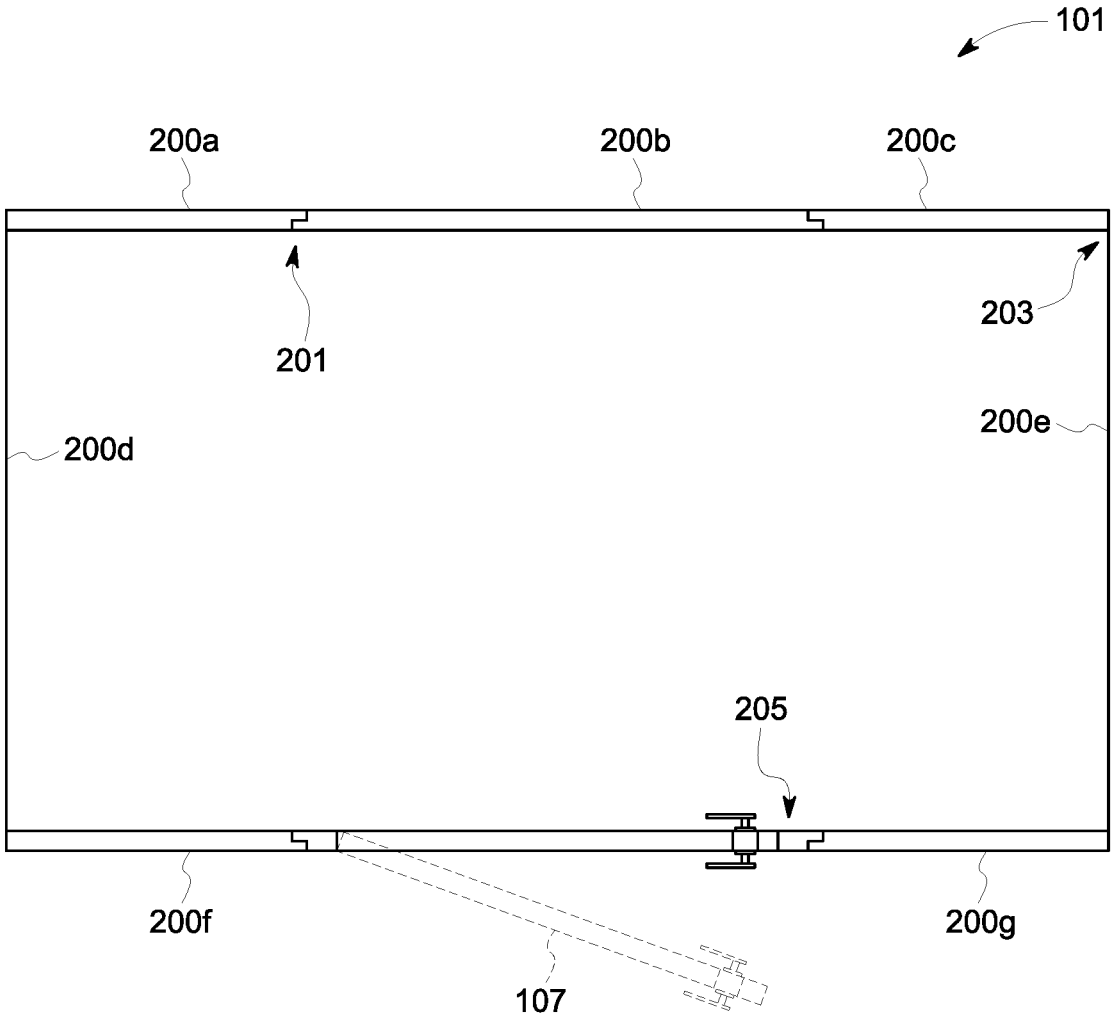
FIG. 2 is a top view of the system of FIG. 1.

As best shown in FIG. 2, each of the plurality of panels 200*a-g* and door 107, are connected to one another via one connections 201, 203, 205, as will be explained herein.

Figure 3:
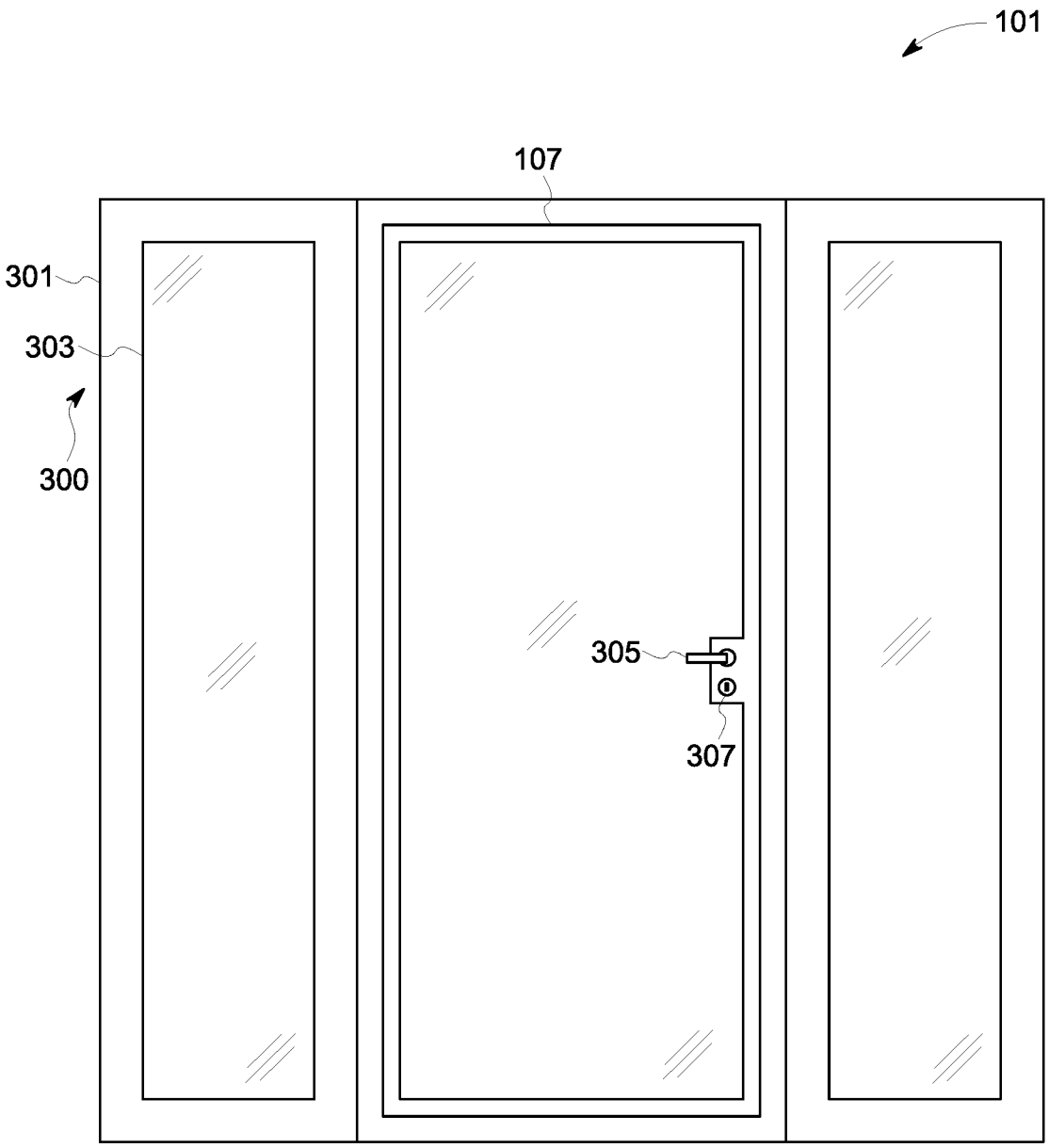
FIG. 3 is a front view of the system of FIG. 1.
Figure 4:
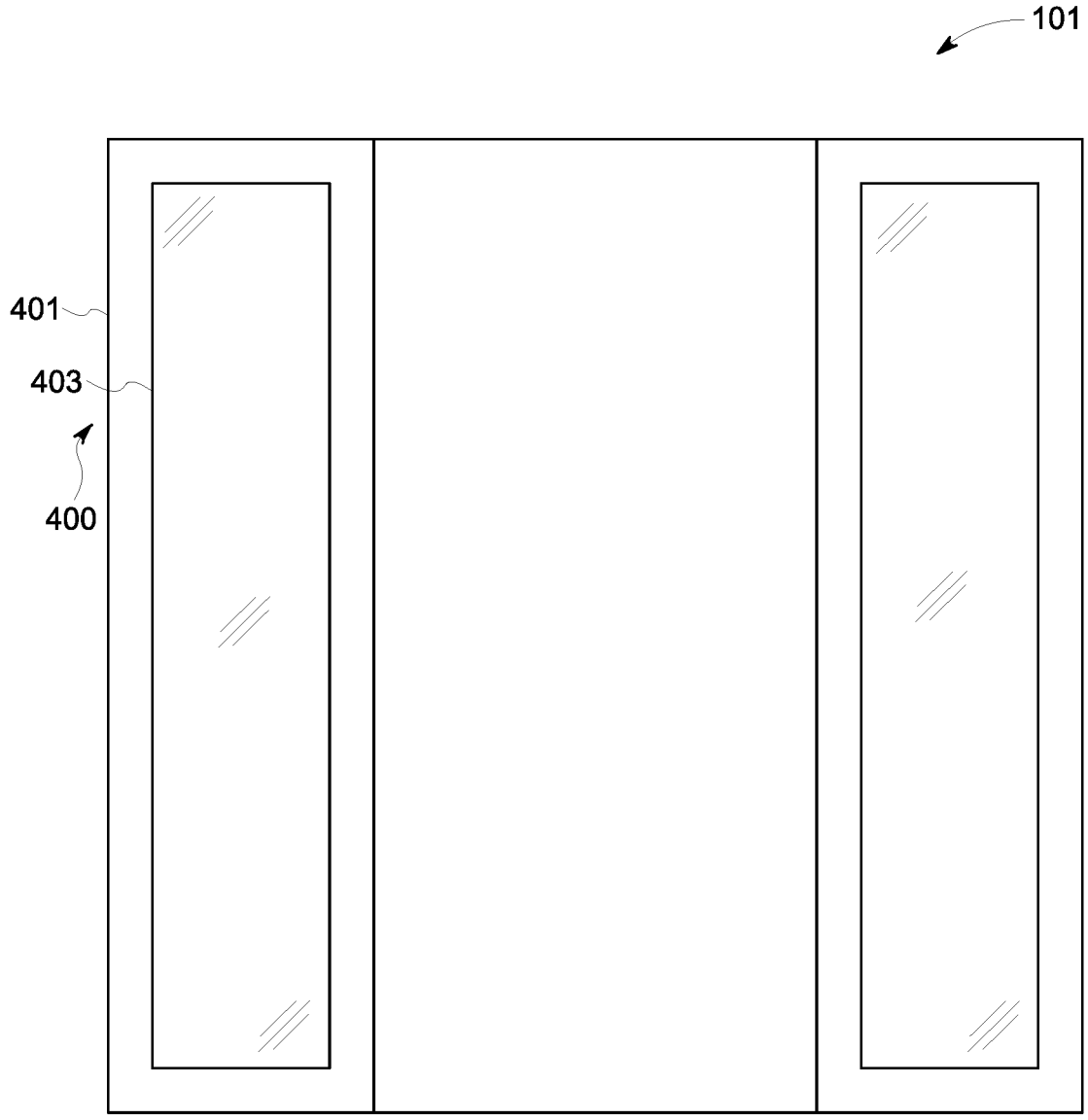
FIG. 4 is a back view of the system of FIG. 1.

As best shown in FIGS. 3 and 4, each panel 300, 400 can include a flanking frame 301, 401 and a solid filler panel 303, 403. It is contemplated that various materials can be used, such as metal, glass, aluminum, wood, or the like. The door 107 further including a handle 305 and lock 307 as desired.

It should be appreciated that one of the unique features believed characteristic of the present application is the connections 201, 203, 205 as will be discussed herein.

Figure 5:
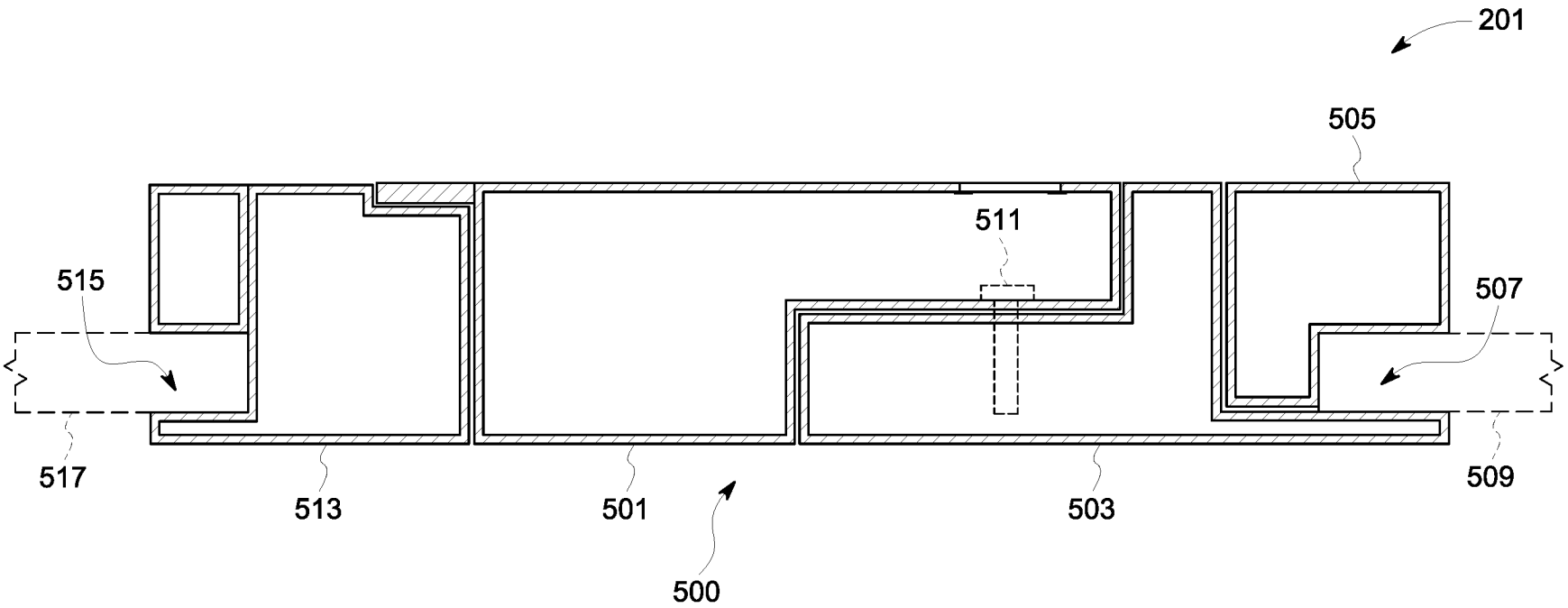
FIG. 5 is a top view of a first connection configured to connect two of the panels of the system of FIG. 1 together.

In FIG. 5, a first connection 201 is shown. It should be appreciated that the connection is configured to provide a substantially seamless exterior 500 associated with the booth. Further, the connection of the various elements is in such a manner that there is improved aesthetical qualities. As shown, the connection includes a mullion 501 that is in an L-shape, wherein a protrusion of the L is configured to align with a portion of a flanking frame 503 of one of the panels. The flanking frame 503 being adjacent to a flanking panel 505, wherein the flanking frame 503 and panel 505 create an opening 507 to receive a solid filler panel 509 of the panel. One or more bolts 511 are used to secure the connection together.

As shown, the mullion 501 is configured to butt up against a door frame 513, the door frame 513 having an opening 515 for receiving a solid filler panel 517.

Figure 6:
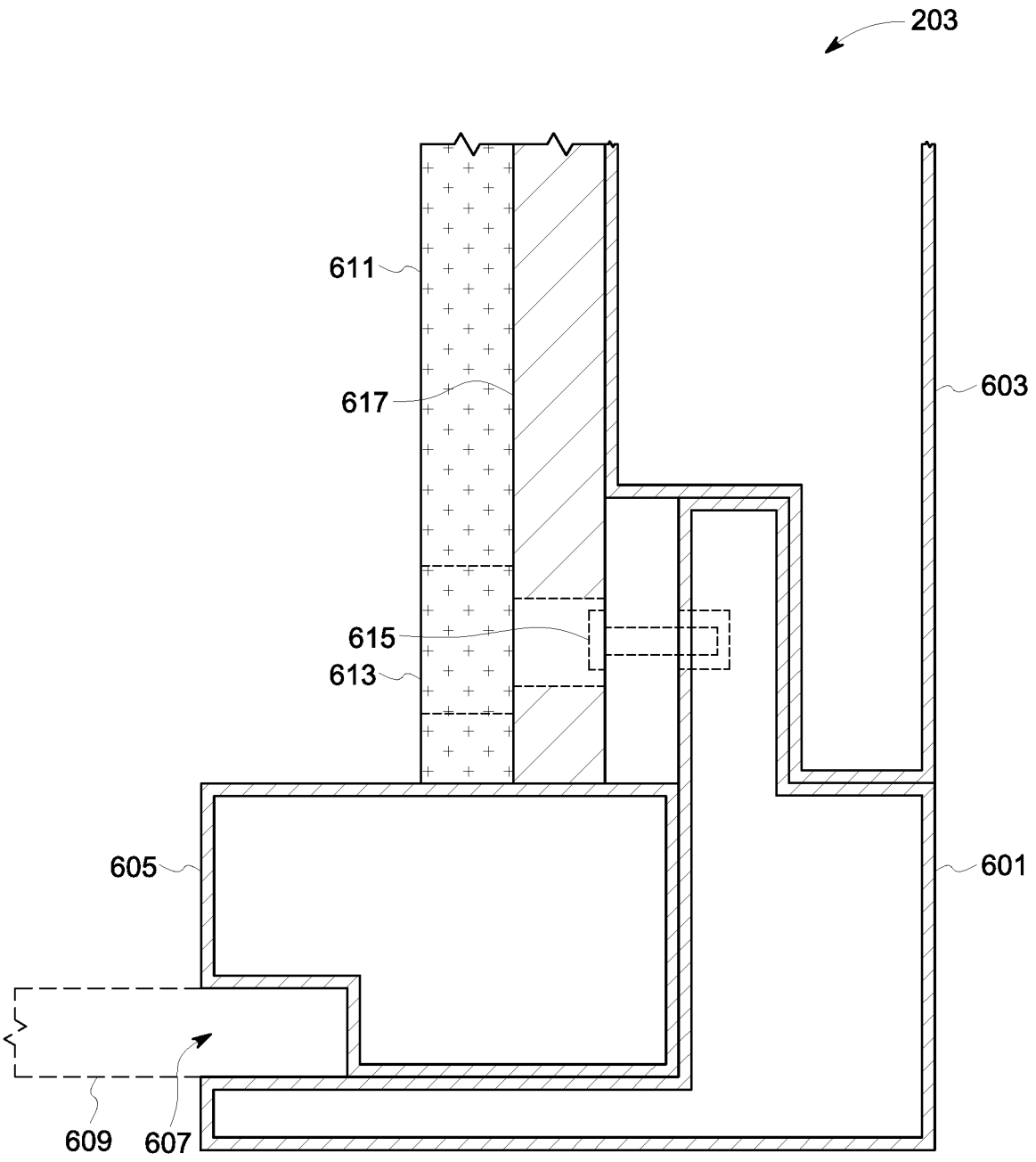
FIG. 6 is a top view of corner connection configured to connect two of the panels of the system of FIG. 1 together at a corner.

In FIG. 6 a corner connection 203 is shown, the corner connection 203 having a corner piece 601 with two protrusions extending therefrom. A flanking frame 603 having a secondary protrusion configured to align with the corner piece as shown, thereby again creating a tight and seamless appearance. The corner piece further engages with a flanking panel 605, again creating an opening 607 to receive a solid filler panel 609.

As further shown, in the preferred embodiment, an acoustical material 611 such as foam, felt, padding, or the like, is secured to an interior surface of the system. In some embodiments, acoustical plugs 613 are provided to maintain a consistent, smooth interior appearance and acoustic level, and such that a user may access an opening to engage a bolt 615 to secure the connection together. A substrate 617, such as wood, can be positioned underneath the acoustic material.

Figure 7:
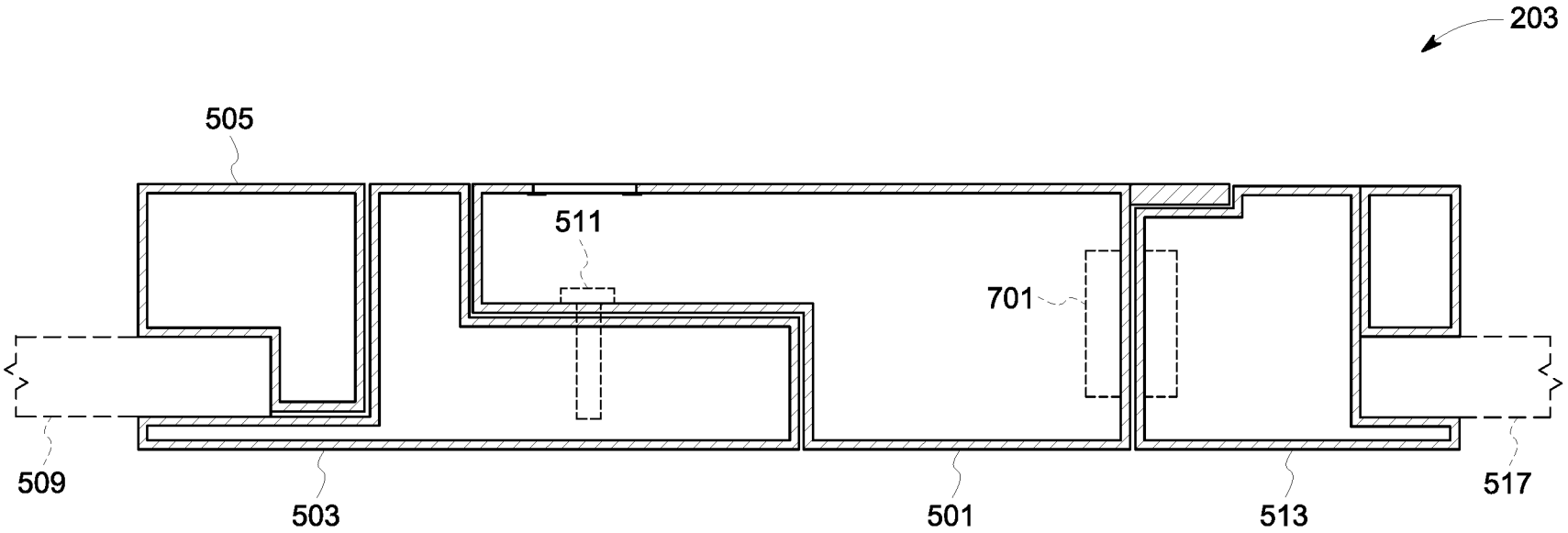
FIG. 7 is a third connection configured to connect a panel and door of the system of FIG. 1 together.

In FIG. 7, a third connection 205 is shown. This connection includes the features discussed above and associated with connection 201. In this embodiment, one or more concealed hinges 701 are shown positioned between the mullion 501 and the door frame 513 and placed vertically on jamb/mullion as required to support the door. In the preferred embodiment, there are three hinges placed vertically on the jamb. It should again be appreciated that this connection provides for improved aesthetical and acoustical properties.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A personal pod system, comprising:

a plurality of panels, each of the plurality of panels extending from a first side to a second side, each of the plurality of panels having a solid filler panel engaged with a flanking panel;

wherein the plurality of panels are configured to secure together to create an interior area;

a first connection configured to connect two of the plurality of panels together, the first connection having:

a mullion having an L-shape and engaged with a flanking frame of a first panel;

one or more bolts configured to secure the mullion to the flanking frame;

the flanking frame having a protrusion configured to extend over a front surface of the solid filler panel;

an interior layer of acoustic material secured to the interior area of the plurality of panels; and a door engaged with the plurality of panels to provide access to the interior area;

wherein the connection is configured to provide a seamless appearance on an exterior of the personal pod system.

2. The system of claim 1, further comprising:

a corner connection configured to connect two of the plurality of panels together at a corner, the corner connection having:

a corner piece having a first extension configured to engage with a flanking panel of the first panel and a second extension configured to engage with a flanking frame of a third panel.

3. The system of claim 1, further comprising:

a door frame engaged with the mullion opposite the flanking frame of the first side panel.

4. The system of claim 3, further comprising:

one or more hinges attaching the door frame to the mullion;

wherein the one or more hinges are concealed from the interior area and an exterior surface of the personal pod system.

5. The system of claim 1, further comprising:

a substrate positioned underneath the acoustic material.

6. The system of claim 1, wherein the acoustic material is a felt.

7. The system of claim 1, further comprising:

a roof secured to a top portion of the plurality of panels.

* * * * *